US006564020B2

(12) United States Patent
Kuribayashi et al.

(10) Patent No.: US 6,564,020 B2
(45) **Date of Patent: *May 13, 2003**

(54) IMAGE FORMING APPARATUS

(75) Inventors: Ikuo Kuribayashi, Shizuoka-ken; Takeshi Tomizawa, Numazu, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,476

(22) Filed: Jun. 8, 1999

(65) Prior Publication Data

US 2001/0046389 A1 Nov. 29, 2001

(30) Foreign Application Priority Data

Jun. 8, 1998 (JP) ..... 10-175398

(51) Int. Cl.[7] ..... G03G 15/00; G03G 15/16; G03G 15/20

(52) U.S. Cl. ..... 399/45; 399/66; 399/314

(58) Field of Search ..... 399/45, 66, 298, 399/310, 311, 313, 314, 390

(56) References Cited

U.S. PATENT DOCUMENTS 5,099,287 A * 3/1992 Sato ..... 399/45
5,113,226 A * 5/1992 Tadokoro et al. ..... 399/390
5,202,727 A 4/1993 Izumizaki et al.
5,253,022 A * 10/1993 Takeuchi et al. ..... 399/313
5,455,664 A * 10/1995 Ito et al. ..... 399/313
5,585,908 A * 12/1996 Rakov et al.
5,598,256 A 1/1997 Kimura et al. ..... 399/316
5,640,658 A 6/1997 Inoue et al.
5,761,572 A * 6/1998 Watanabe et al. ..... 399/66
5,905,925 A * 5/1999 Kawabata et al. ..... 399/45

FOREIGN PATENT DOCUMENTS

JP 54-80135 6/1979

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image bearing member for bearing an image; a movable recording material carrying member for electrostatically carrying the recording material; transfer means for electrostatically transferring the image from the image bearing member onto the recording material carried on the recording material carrying member at a transfer position, the transfer means being located at a position across from a side of the recording material carrying member carrying the recording material; and control means for controlling timing of start of change of a current flowing through the transfer means in accordance with a kind of the recording material so that the current reaches a level effective to transfer the image from the image bearing member onto the recording material carried on the recording material carrying member within a period in which a non-image formation area of the recording material at its leading edge is passing the transfer position.

22 Claims, 8 Drawing Sheets

IMAGE FORMING APPARATUS

FIELD OF THE INVENTION AND RELATED ART

The present invention relates to an image forming apparatus, for example, a copying machine, a printer, a facsimile machine, and the like, for electrostatically forming an image on a recording medium.

There have been known such recording apparatuses as copying machines, laser beam printers or the like, that form full-color images by repeating for yellow, magenta, cyan, and black toners, a process in which a toner image is formed on a photosensitive drum, and the toner image is transferred from the photosensitive drum onto a recording medium borne on the recording medium bearing portion (peripheral surface) of a transfer drum.

Briefly describing such an image forming apparatus, first, a recording medium is conveyed to a transfer drum with a predetermined timing, and adhesion current is flowed to the back side of the transfer sheet from an adhesion brush (at this moment, an electrically conductive roller is in contact with the recording medium), causing the recording medium to be electrostatically adhered to the transfer sheet. Then, the yellow color toner image which was formed on the photosensitive drum is transferred onto the recording medium having been adhered to the transfer sheet. This process is also carried out for magenta, cyan, and black toners. As a result, a full-color image is formed on the recording medium. In this transfer process, a voltage with a predetermined level is applied to the inward side of the transfer sheet by a transfer charging device constituted of a transfer brush or the like. The recording medium on which a full-color image has been formed is separated from the transfer sheet, and the toner image is fixed to the recording medium by a fixing device. Thereafter, the recording medium is discharged from the image forming apparatus. The transfer sheet from which the recording medium has been separated is cleared of electrical charge by an inside charge removing device and an outside charger removing device, which are on the inward and outward sides, respectively, of the transfer sheet, and then, its surface is cleaned by a cleaning apparatus.

In the case of the aforementioned full-color image forming apparatus, the electrical potential on the surface of the transfer sheet fluctuates as follows. That is, first, the surface of the transfer sheet is initialized by the inside and outside charge removing devices. It is assumed that the voltage level of the transfer sheet after the charge removal is V0. Thereafter, the voltage level on the back surface of the transfer sheet increases by Vq as an adhesion voltage is applied to the back surface of the transfer sheet in order to bear and hold a sheet of recording medium on the transfer sheet. Also in the transfer process, the back surface potential of the transfer sheet fluctuates by a voltage level of Vt as transfer voltage is applied to the transfer sheet from the transfer brush.

In the case of the full-color image forming apparatus (full-color copying machine), this transfer process is carried out four times per full-color image, and then, the recording medium is separated from the transfer sheet. Assuming that the voltage level of the transfer voltage is constant, the voltage level on the back surface of the transfer sheet increases by $V_1=V_0+V_q+4\times V_t$, through a total of four transfer processes.

As is commonly known, edges of a sheet as recording medium have burrs. If these burrs at the edges of a recording sheet face the transfer drum, and the transfer voltage is applied, starting from the leading edge of the recording sheet, such force that causes the recording sheet and the photosensitive drum to be attracted to each other is generated. As a result, the force which causes the leading edge of the recording sheet to be attracted to the transfer drum is reduced, allowing the leading edge of the recording sheet to be lifted from the transfer drum. This results in the production of an image of low quality traceable to transfer failure. In an extreme case, the recording sheet is wrapped around the photosensitive drum, making recording sheet conveyance impossible.

Thus, in the case of this image forming apparatus, control is executed so that transfer current does not flow at the leading edge of a recording sheet. More specifically, where the leading edge of a recording sheet is on the transfer sheet, the potential level of the transfer brush is made to be the same as that of the transfer sheet so that current does not flow from the transfer brush to the transfer sheet (and recording sheet).

In the region in which control is carried out to prevent transfer current from flowing, the potential level of the transfer sheet is kept at the initial state; it remains at $V_0+V_q$ until the end of the formation of each full-color image. Therefore, in the case of an image forming apparatus such as this image forming apparatus, the level of transfer voltage must be increased from $V_0+V_q$ to $V_{last}(V_{last}>V_1)$ during the period from when the leading edge of a recording sheet, that is, the leading edge of the leading margin portion of a recording sheet, makes contact with the transfer sheet, to when the trailing edge of the leading margin portion of the recording makes contact with the transfer sheet. This fluctuation in the transfer voltage is shown in FIG. 8.

When the capacity of a transfer sheet is $C_{pt}$; the capacity of a recording medium is $C_{pp}$; the amounts of electrical charge necessary for the adhesion and the transfer are $Q_q$ and $Q_t$, respectively (these values are dependent upon the characteristic of the photosensitive drum or the amount of toner charge, and in a stable environment they are not dependent upon the characteristic of the transfer sheet or the recording medium; they remain stable), $V_q=Q_q\times(1/C_{pt}+1/C_{pp})$, and $V_t=Q_t\times(1/C_{pt}+1/C_{pp})$.

In the past, 150 $\mu$m thick polycarbonate has been used as the material for the transfer sheet. However, the dielectric constant of the polycarbonate is approximately 3, relatively low compared to that of PVDF (polyvinylidene), which is 10. Further, the capacity $C_{pt}$ of the transfer sheet is proportional to the dielectric constant of the transfer sheet. Therefore, the usage of the polycarbonate as the material for the transfer sheet made the transfer sheet capacity $C_{pt}$ small. As a result, the amount of the electrical charge necessary for the transfer process makes the values of the $V_q$ and $V_t$ rather large.

Further, in an environment with low humidity, or as the thickness of a recording medium is increased, the dielectric constant of the recording medium becomes extremely small, which also increases the values of the $V_q$ and $V_t$. In reality, the average dielectric constant of a sheet of recording paper under the low humidity condition is 2–4. For example, if a recording sheet is approximately 100 $\mu$m in thickness, and 3 in dielectric constant, the amount by which the potential level of a transfer sheet or a recording sheet increases is approximately 4–8 kV. It is extremely difficult to increase the potential level of the transfer sheet or the recording sheet by this much amount within a short period equivalent to the very narrow width, in terms of the sheet conveyance direction, of the leading margin portion of the recording sheet (if the width of the margin is 8 mm, and the process speed is 200 mm/sec, the potential level must be increased by 4–8 kV in 40 milliseconds). As a result, the problem frequently occurs that a copy lacking the portion of the image at the leading end is produced.

SUMMARY OF THE INVENTION

Accordingly, it is a principal object of the present invention to provide an image forming apparatus, method and a control system therefor wherein a defect adjacent a leading edge of a recording material is suppressed or removed.

It is another object of the present invention to provide an image forming apparatus, method and a control system therefor wherein a clear image can be formed from the leading edge of the recording material.

According to an aspect of the present invention, there is provided an image forming apparatus comprising an image bearing member for bearing an image; a movable recording material carrying member for electrostatically carrying the recording material; transfer means for electrostatically transferring the image from said image bearing member onto the recording material carried on said recording material carrying member at a transfer position, said transfer means being located at a position across from a side of said recording material carrying member carrying the recording material; and control means for controlling timing of start of change of a current flowing through said transfer means in accordance with a kind of the recording material so that the current reaches a level effective to transfer the image from said image bearing member onto the recording material carried on said recording material carrying member within a period in which a non-image formation area of the recording material at its leading edge is passing the transfer position.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, an image forming apparatus in accordance with the present invention will be described with reference to the appended drawings.

Embodiment 1

Figure 7:
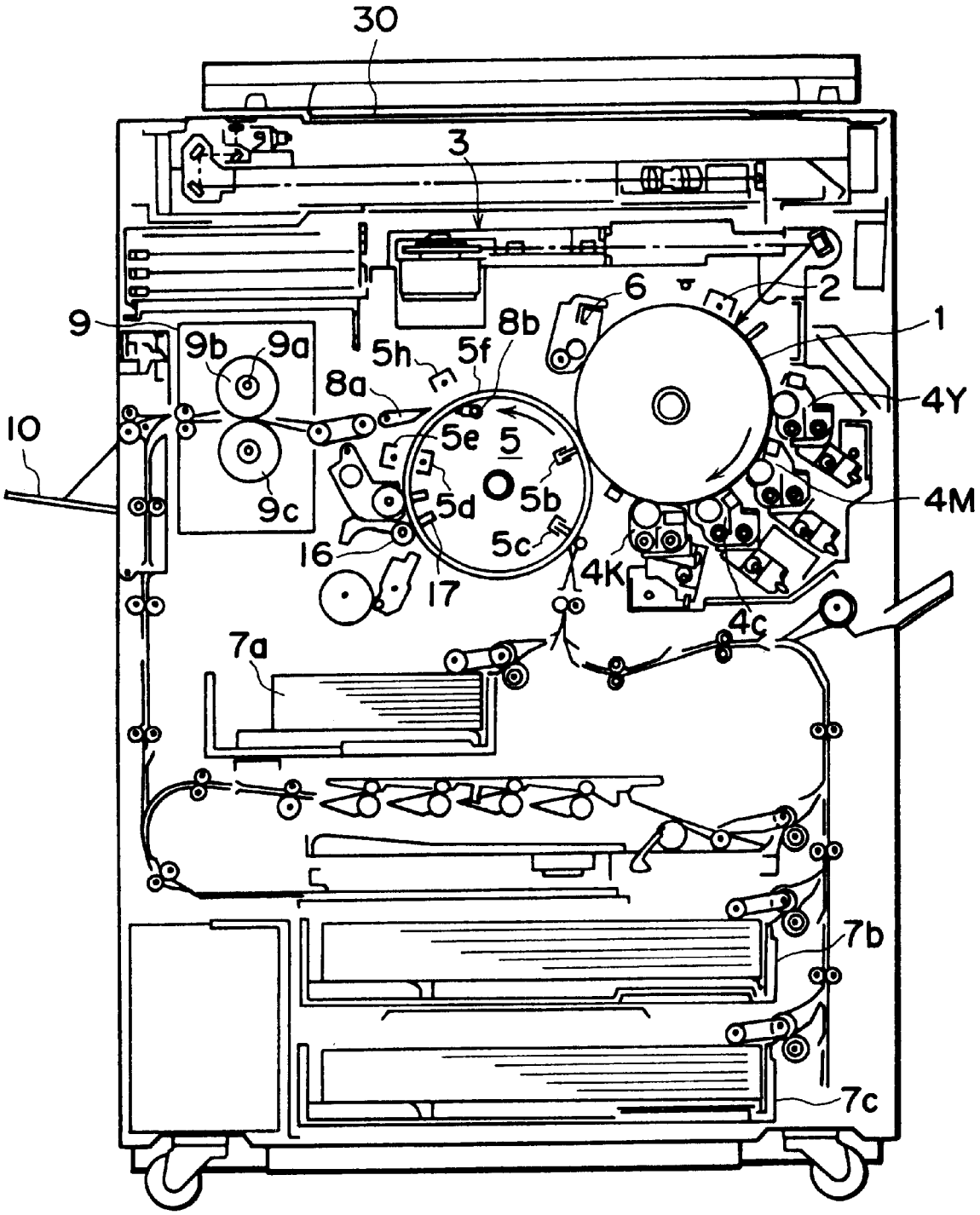
FIG. 7 is a schematic sectional view of an example of an embodiment of the present invention in the form of a full-color image forming apparatus.
Figure 8:
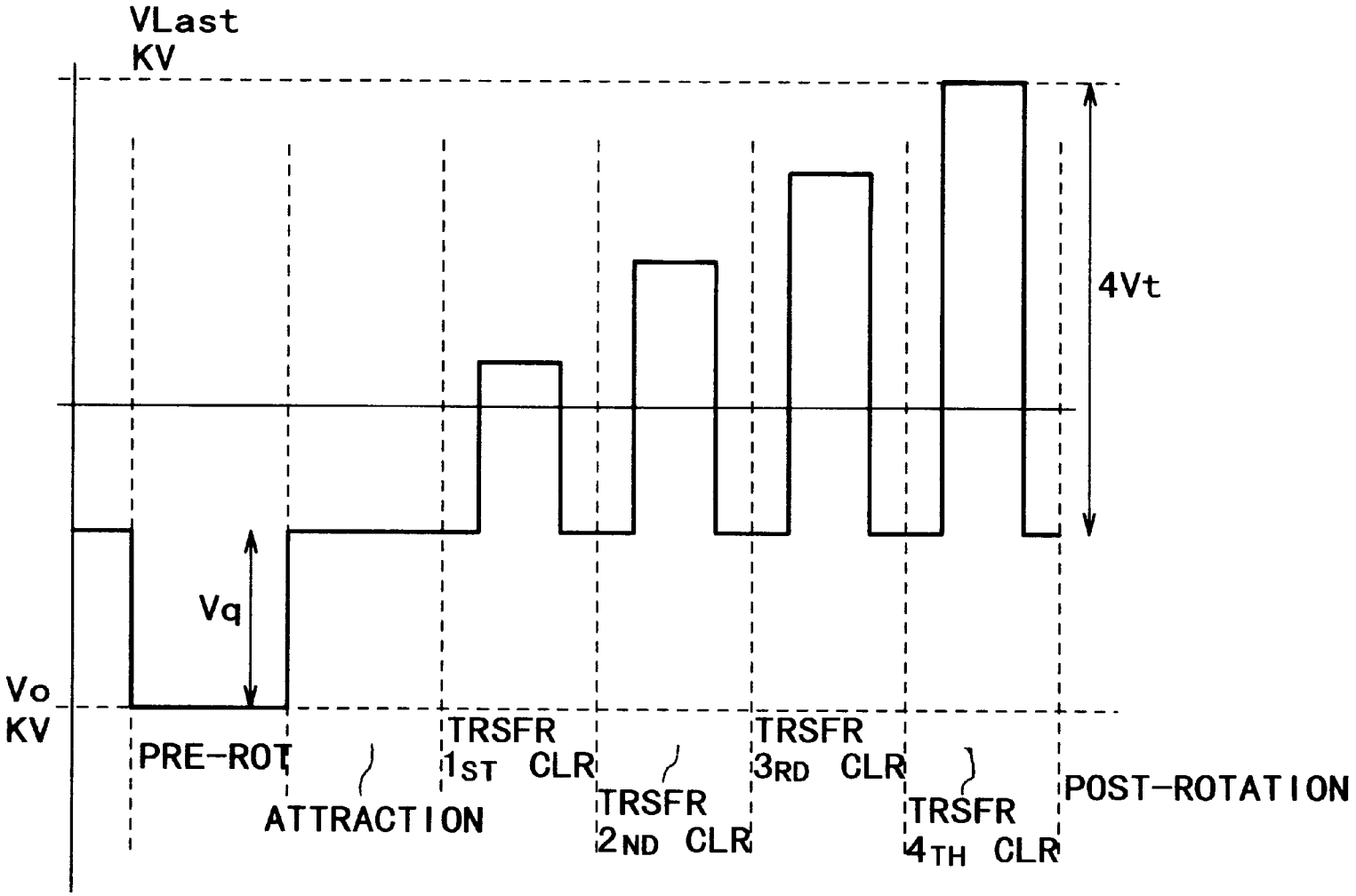
FIG. 8 is a graph which shows the fluctuation of the voltage level on the transfer sheet of the transfer drum in a conventional full-color image forming apparatus.

FIG. 7 shows the general structure of an image forming apparatus in accordance with the present invention. The configuration and components of this image forming apparatus will be described in their logical order.

As for the basic structure, the image forming apparatus comprises a photosensitive drum 1 as an image bearing member, and various image forming means: a charging device 2, an optical apparatus 3 as a latent image forming means, developing devices 4Y, 4M, 4C, and 4K as means for developing yellow, magenta, cyan, and black colors, correspondingly, a transfer drum 5 as a recording medium bearing member, a transfer charge brush (which may be in the form of a blade) as a transferring means for transferring a toner image onto the recording medium, and a cleaner 6, which are disposed along the peripheral surface of the photosensitive drum 1 in a manner to surround the photosensitive drum 1.

Next, the process in which a full-color image is formed on a recording medium will be described. First, on the peripheral surface of the photosensitive drum 1 having been uniformly charged by the charging device 2, the portion for the first color (for example, yellow color) in the image formation data sent from a reader portion 30 is materialized in the form of a latent image by the optical apparatus 3. This latent image on the photosensitive drum 1 is developed by the toner (in this embodiment, negatively chargeable toner) correspondent to the first color into a visual image (first toner image). Then, the toner image is transferred onto a recording medium P borne on the transfer drum 5 after having been conveyed from a sheet feeder cassette 7 (7*a*, 7*b*, and 7*c*). During this transfer process, a voltage with a predetermined magnitude (in this embodiment, positive voltage) is applied to the transfer charge brush 5*b*. The photosensitive drum 1 is cleared of the toner remaining on its peripheral surface, being prepared for the image formation cycle for the next color.

The diameter of the photosensitive drum 1 is approximately the same as that of the transfer drum 5; in other words, the curvature of the peripheral surface of the photosensitive drum 1 is approximately the same as that of the transfer drum 5.

The above described process is carried out for the rest of the colors (magenta, cyan, and black colors). As a result, a full-color image is formed on the recording medium P. After the last transfer process, the recording medium P is separated from the transfer drum 5 by a separating means comprising a separation charger 5*h*, a separation claw 8*a*, a pusher roller 8*b* for separation, and is delivered into a tray 10 through a fixing device 9.

After the removal of the recording medium P having been borne on the surface of the transfer drum 5, the transfer drum 5 is cleared of the unnecessary toner which is still adhering to its peripheral surface, by transfer cleaners 16 and 17, being prepared to bear the following sheet of recording medium.

The fixing device 9 comprises a fixing roller 9*b*, which contains a heater 9*a* (heat source), and a pressure roller 9*c*, which is placed in contact with the fixing roller 9*b* by the application of a predetermined amount of pressure. In operation, heat is applied to the recording medium P while the recording medium P is being conveyed through the fixing device, so that the toner image on the recording medium P is welded to the recording medium P.

In the case of a full-color copying machine employing such a multiple layer transfer system as the one described above, it is desired that approximately 75–150 μm thick PC (polycarbonate) or PET (polyethyleneterephthalate) is used as the material for the transfer sheet 5*f* of the transfer drum 5. This is due to the fact that these materials are superior to PVDF (polyvinylidene fluoride) in terms of durability, as well as ease of disposal at the end of their service lives.

Figure 1:
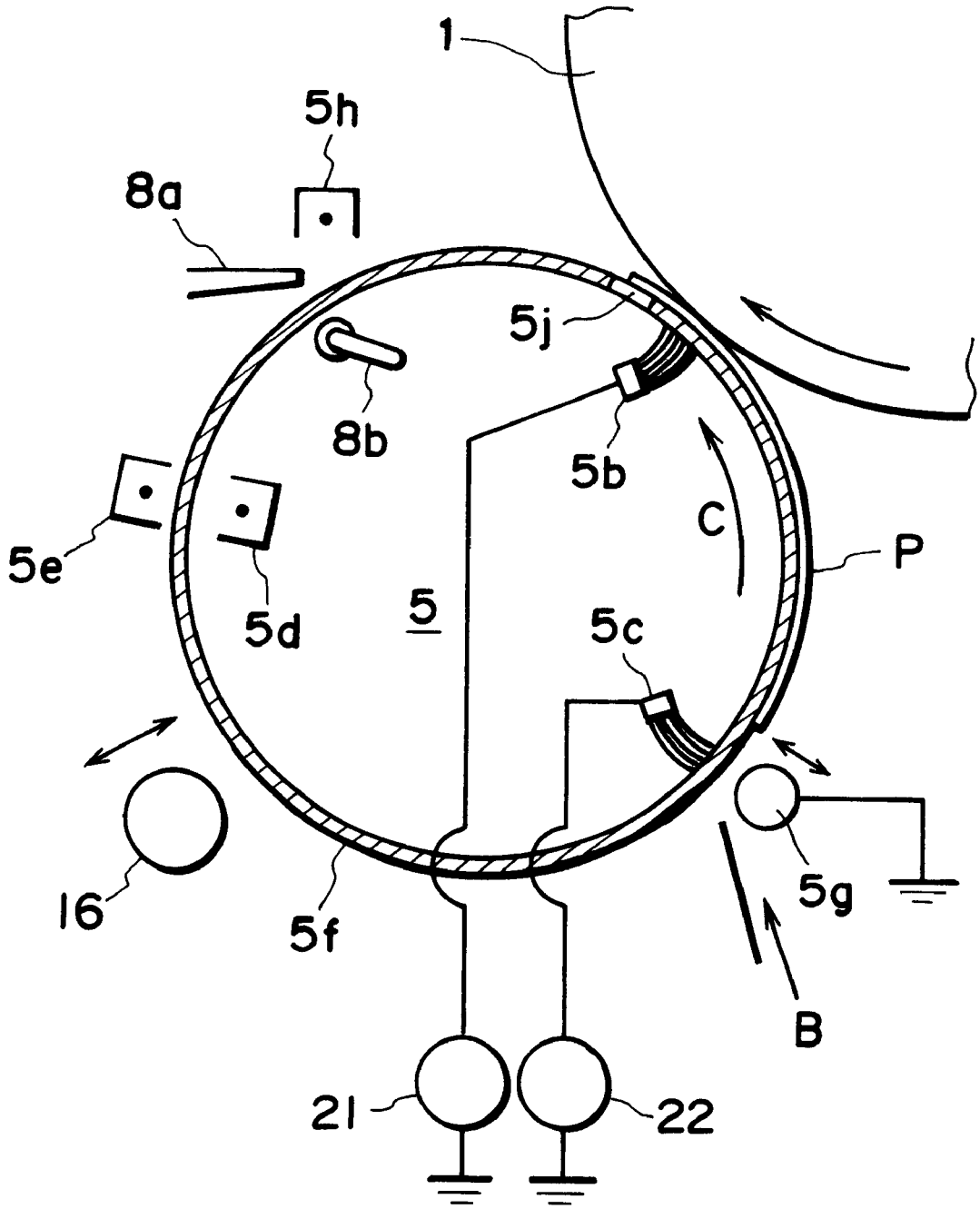
FIG. 1 is a schematic section of the transfer drum and its adjacencies in the first embodiment.

Next, the operation of this image forming apparatus will be described in further detail with reference to FIG. 1.

The transfer drum 5 comprises a transfer sheet 5*f*, which is wrapped around the periphery of the transfer drum 5, and to which the recording medium P is electrostatically adhered in order to be conveyed in the direction indicated by an arrow mark C. The leading and trailing ends of the transfer sheet 5*f* are glued to the connecting member 5*j* of the transfer drum 5. In this embodiment, 150 μm thick PC (polycarbonate) film with a volumetric resistivity of no less than $10^{15}$ Ω cm is used as the material for the transfer sheet 5*f*.

In an image forming operation, first, the inward and outward charge removing devices 5*d* and 5*e* are activated to initialize the transfer sheet 5*f* in terms of electrical potential. The recording medium P is fed by an unillustrated sheet conveying means from the direction indicated by an arrow mark B. An adhesion roller 5*g* is moved to the transfer sheet 5*f* by an unillustrated driving source, and placed in direct contact with the transfer sheet 5*f*, allowing the adhesion voltage (electrical charge) to be applied from a high voltage power source 20 to the transfer sheet 5*f*, on the side (back side) opposite to the recording medium bearing surface, through an adhesion charge brush 5*c*. Since the adhesion roller 5*g* is grounded, a voltage (positive charge) with the polarity opposite to that of the voltage (negative voltage) applied to the adhesion brush is induced. As a result, the entirety of the recording medium P is electrostatically adhered to the transfer sheet 5*f*. As soon as the recording medium P is adhered to the transfer drum 5, the adhesion roller 5*g* is quickly moved away from the transfer drum 5.

Next, voltage (positive charge) is applied to the transfer charge brush 5*b* from a high voltage power source 21, and the negatively charged toner image having been formed on the photosensitive drum 1 is transferred onto the recording medium P. It should be noted here that in this embodiment, a photosensitive drum comprising a surface layer formed of organic photoconductor is employed as the photosensitive drum 1. Further, the so-called reversal development system is employed, according to which a photosensitive drum is initially charged to the same polarity as that of toner, or the negative polarity, and toner adheres to the portions of the peripheral surface of the photosensitive drum, where the amount of charge has been reduced due to the exposure to a laser beam. In a multiple layer transfer process, the transfer operation is repeated a predetermined number of times per each recording medium, and then, the recording medium is separated from the transfer drum 5 by the separation roller 8*h*, separation roller 8*a*, and separation charging device 5*h*.

The aforementioned inward and outward charge removing devices 5*d* and 5*e* are activated before and after the aforementioned operational sequence comprising adhesion, transfer, and separation, to initialize the transfer sheet 5*f* in terms of electrical potential.

In the past, in order to improve a full-color image forming apparatus, in particular, one equipped with a transfer drum, in terms of the efficiency with which a recording medium is adhered to the transfer drum, a recording medium has been curled so that its curvature coincides with that of the peripheral surface of the transfer drum.

As for an apparatus for curling a recording medium while the recording medium is in the recording medium conveying portion, it was provided with a curling mechanism (pair of rollers) of a sponge roller type or a Mickey roller type, through which a recording medium is passed to give the recording medium a predetermined amount of curl.

Also in the past, in order to give a recording medium a larger amount of curl, a method such as increasing the pressure applied by the pair of curling rollers, or changing the angle of the recording medium conveyance path relative to the nip between the pair of curling rollers, at the entry and exit sides of the nip, has been used.

At this time, the recording medium curling portion 50 and the registration roller 60 portion in this embodiment will be described in detail.

Figure 2:
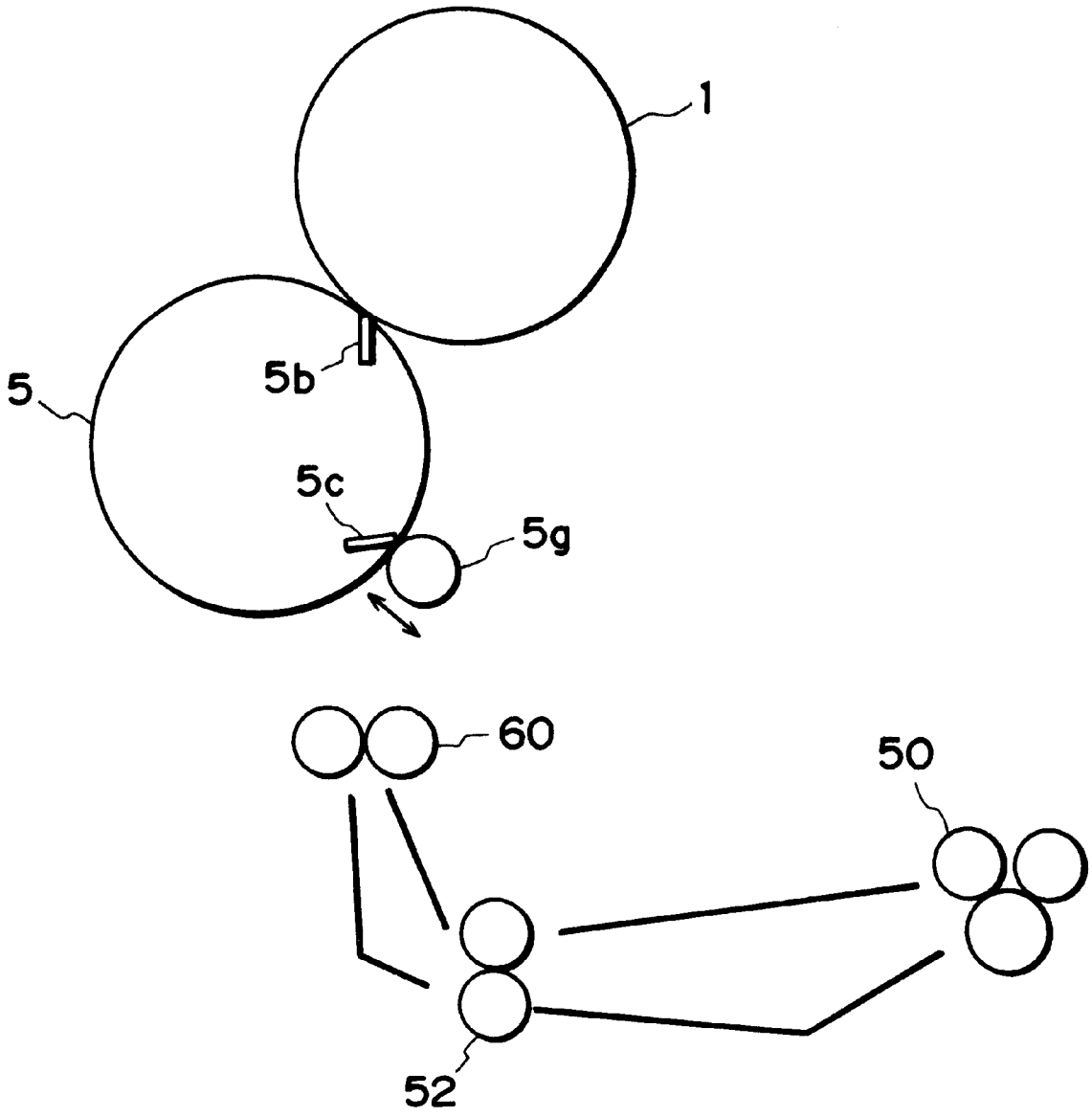
FIG. 2 is a schematic drawing which shows the configuration of the recording medium conveyance path in the first embodiment.

In FIG. 2, the recording medium conveyance path ranging from the recording medium curling portion 50 to the registration roller portion 60 is shown.

Figure 3:
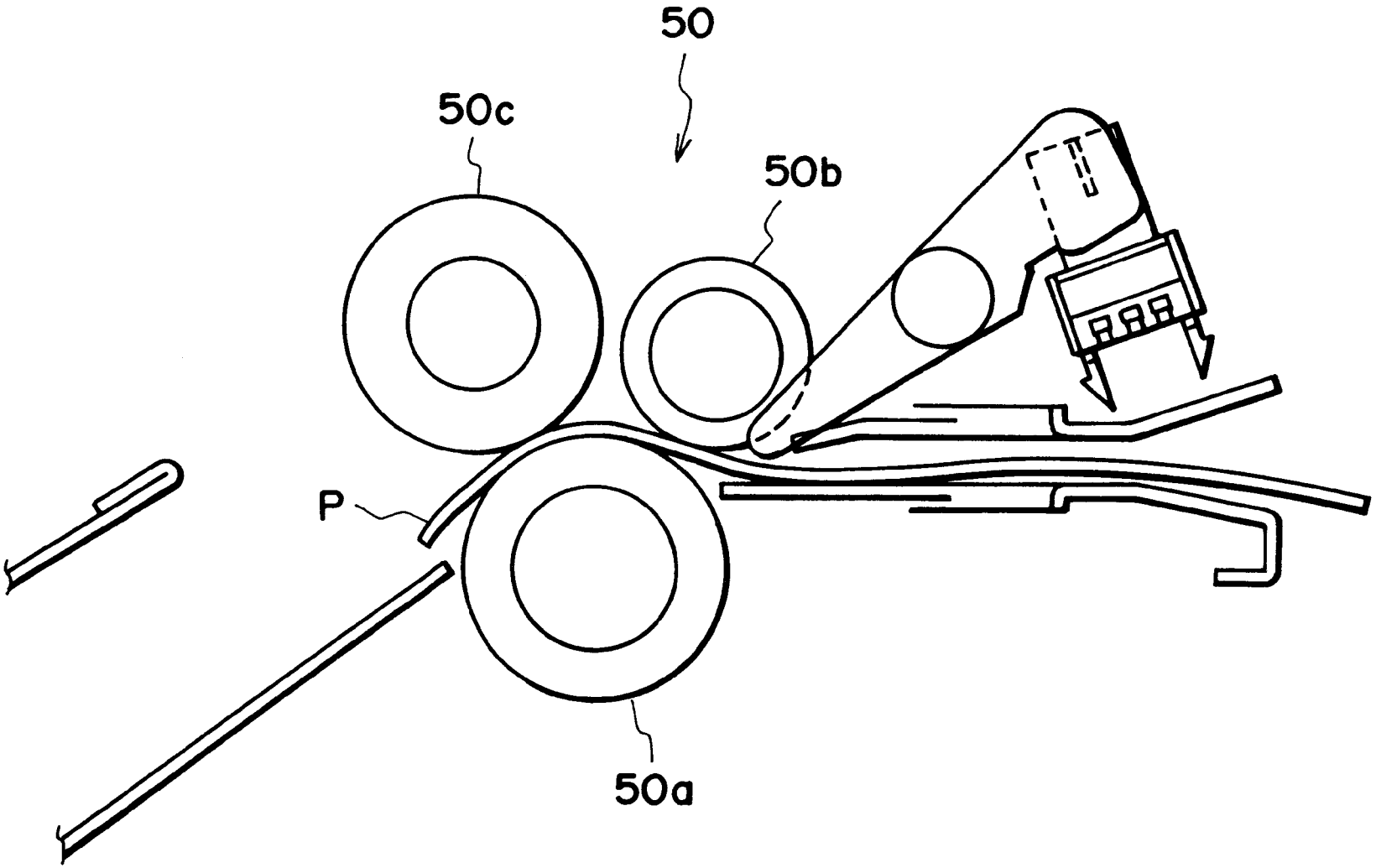
FIG. 3 is a schematic drawing which shows the structure of the curling mechanism in the first embodiment.

Referring to FIG. 3, the curling portion (mechanism) 50 in this embodiment is of the so-called Mickey roller type, which comprises a driver roller 50*a*, and curling rollers 50*b* and 50*c*. As a recording medium is conveyed through this curling portion, it is squeezed so that it is curled in the downward direction in FIG. 3.

Also referring to FIG. 2, there is disposed on the downstream side of the curling portion 50, a pair of conveyer rollers 52 for stabilizing the recording medium conveyance. After the curling, the recording medium is changed in direction on the downstream side of the pair of conveyer rollers 5; and arrives at a pair of registration rollers 60, by which the recording medium is corrected in its direction relative to the conveyance direction, and sent to the transfer drum 5 with a predetermined timing.

Figure 4:
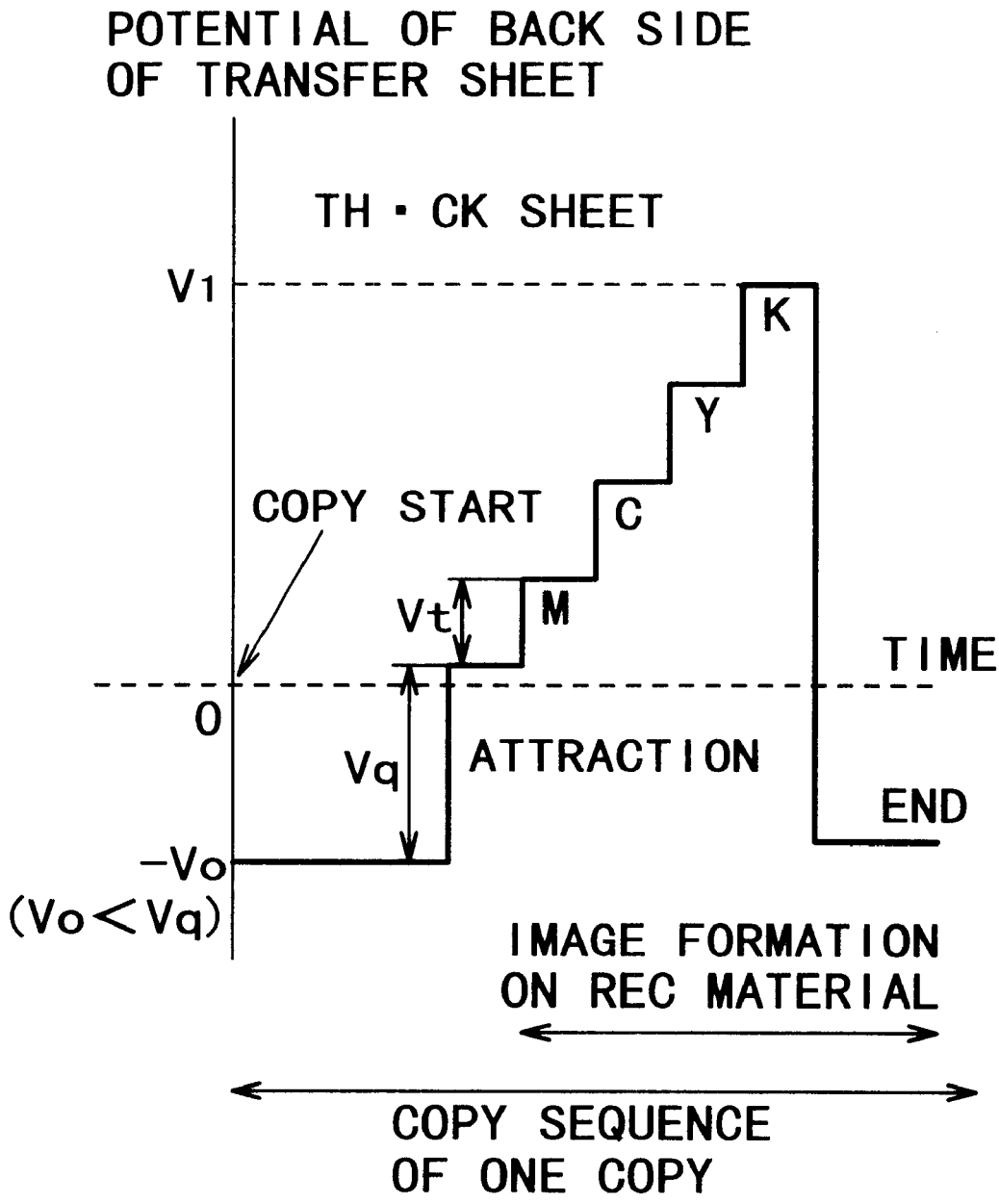
FIG. 4 is a graphical drawing which shows the state of the electrical charge on the sheet of the transfer drum.

In a full-color image forming apparatus such as the above described one, the state of electrical charge on the surface of the transfer sheet of the transfer drum changes as illustrated in FIG. 4.

More specifically, the transfer sheet 5*f* is initialized in terms of the potential levels on its front and back surfaces by the inward and outward charge removing devices 5*d* and 5*e*, so that the potential level of the transfer sheet 5*f*, on the back side (side with which adhesion brush and transfer brush come in contact) uniformly becomes $-V_0$ (V) across the entire surface. Then, in order to hold the recording medium P to the front surface of the transfer sheet 5*f*, electrical charge is given to the transfer sheet 5*f*, on the back side, so that the potential level on the back side of the transfer sheet 5*f* becomes $-V_q$ (V). As a result, the potential level of the transfer sheet 5*f*, on its back side, changes to $-V_0+V_q$ (V).

In the next process, the transfer process, electrical charge is given to the back side of the transfer sheet 5*f* by the transfer brush 5*b*, so that the potential level on the back side of the transfer sheet 5*f* increases by a voltage level of $V^T$. As a result, the potential level on the back side of the transfer sheet 5*f* is changed to $-V_0+V_q+V_T$ (V). In the case of the full-color image forming apparatus in this embodiment, this transfer process is repeated four times per recording medium, and then, the recording medium is separated from the transfer drum 5. Consequently, the potential level on the back side of the transfer sheet 5*f* finally increases to $-V_p+V_q+4\times V_T$ (v).

As described previously, as a sheet of recording paper is cut, or is subjected to the like processes, edges with burrs are created. These burrs keep the edges of the recording medium away from the transfer drum 5. In this state, if the transfer voltage is applied to the recording medium, starting from the leading edge, the force which causes the recording medium and the photosensitive drum 1 to attract each other increases, reducing the effectiveness of the force which causes the leading edge of the recording medium to adhere to the transfer drum 5. As a result, the leading edge of the recording medium is not adhered to the transfer drum 5. This creates problems. For example, if the nonadherence of the recording medium to the transfer drum 5 extends beyond the leading white margin portion of the recording medium, an image with low quality traceable to transfer failure is produced, and in an extreme case, the recording medium is wrapped around the photosensitive drum 1, making the recording medium conveyance itself impossible.

Thus, control is executed to prevent the transfer current from flowing at the leading edge of a recording medium. More specifically, the transfer voltage applied to the transfer brush is controlled to equalize its voltage level to the potential level of the transfer sheet (transfer 0 $\mu$A control), so that current does not flow from the transfer brush to the transfer sheet (and recording medium).

In the region in which control is executed to prevent the transfer current from flowing through the leading edge portion of the recording medium, the potential level of the transfer sheet is kept at the initial level; in other words, it remains at the voltage level of $V_0$ until the end of each image formation cycle. Therefore, it is necessary in a full-color image forming apparatus such as a conventional full-color image forming apparatus that the transfer voltage be started up from $V_0$ to $V_1$.

In a conventional image forming apparatus, 150 $\mu$m thick polycarbonate film is used as the material for the transfer sheet. However, the dielectric constant of the polycarbonate is approximately 3, low compared to that of PVDF, which is 10. Therefore, the values of $V_q$ and $V_t$ are very large. Further, if a thick recording medium, which is extremely low in dielectric constant, is used, the values of $V_q$ and $V_t$ also become extremely large, making it extremely difficult to start up the transfer voltage in a very short time equivalent to the width of the white margin at the leading end of a recording sheet. Consequently, copies produced by a conventional image forming apparatus sometimes suffer from the problem that the portion of the image on the copy, on the leading end, is missing by a substantial width.

Since the thicker a recording medium (the greater the basis weight), the greater the effect of the curling, that is, the greater the force with which the recording medium wraps itself around the transfer drum, even if transfer voltage is applied, starting from the leading edge, the force which keeps the leading end of the recording medium adhered to the transfer drum does not become instable.

Thus, in this embodiment, in consideration of the importance of the adherence of the leading edge portion of a recording medium to the transfer drum, control is executed so that transfer current basically does not flow through the leading edge portion of the recording. However, when an image is formed on a thick recording medium, the curling mechanism is activated, and the transfer voltage is applied to the recording medium, starting from the leading edge.

Switching the way transfer voltage is applied to the leading edge of a recording medium depending upon the type of recording medium as described above makes it possible to assure both sufficient adhesion of the recording medium to the transfer drum and the image quality at the leading end of the recording medium.

Figure 5:
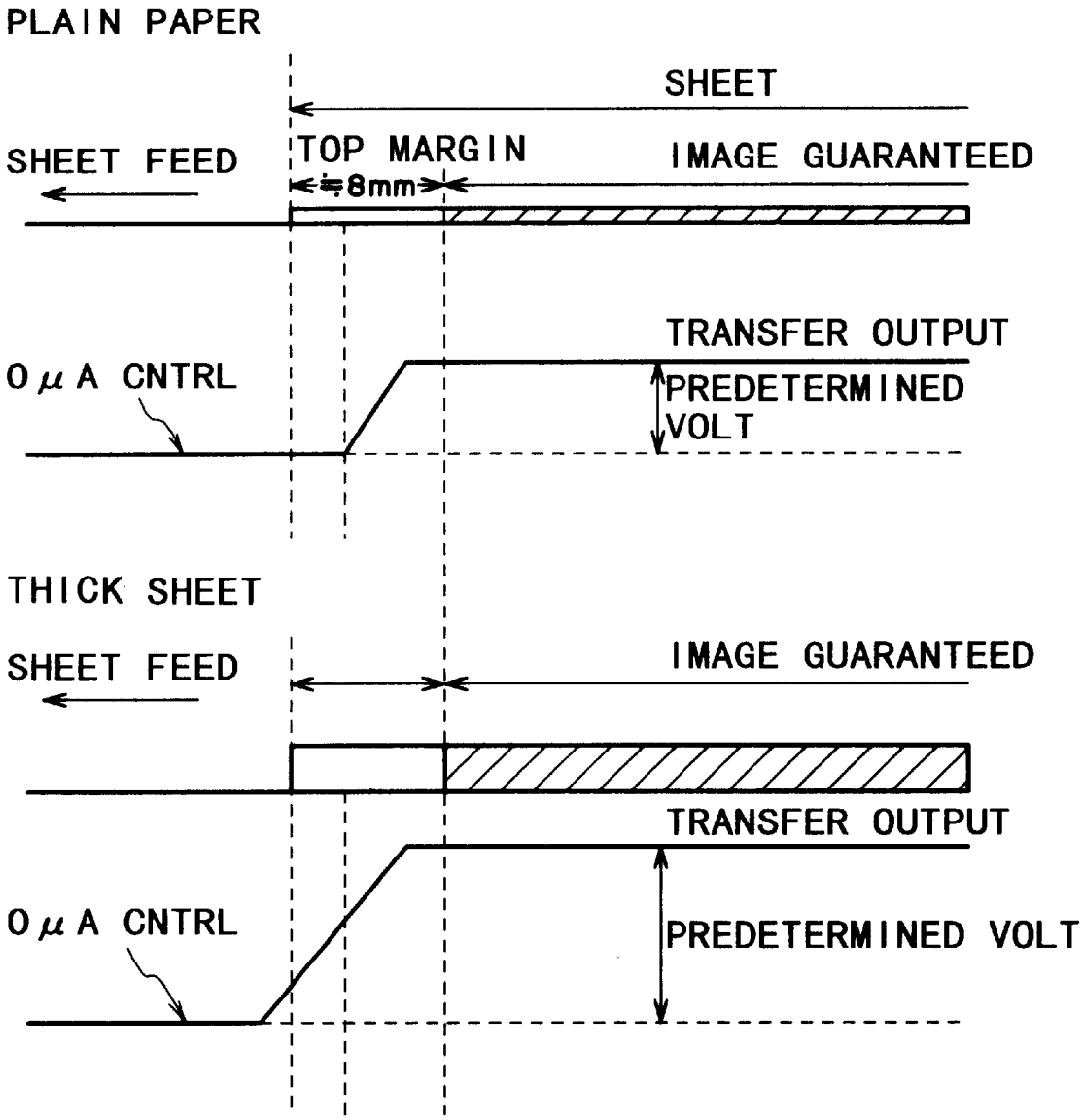
FIG. 5 is a schematic drawing which shows the transfer voltage levels for an ordinary recording sheet and a thick recording sheet in the first embodiment.

According to the research by the inventors of the present invention, if a recording medium is a sheet of paper with a basis weight of no less than 130 g/m$^2$, the effect of the curling mechanism becomes large enough so that even if transfer voltage is applied to the recording medium, starting from the leading edge, the recording medium is reliably conveyed. FIG. 5 graphically shows the transfer voltage applied when an image is formed on an ordinary sheet of paper with a basis weight of approximately 80 g/m$^2$ with the use of the image forming apparatus in this embodiment, and the transfer voltage applied when an image is formed on a thick sheet of paper with a basis weight of approximately 200 g/m$^2$.

Referring to FIG. 5, in the case of an ordinary sheet of paper, the application of the transfer output began within the leading end margin of the sheet, whereas in the case of a sheet of thick paper, the application of the transfer output had begun at the leading edge of the sheet. In both cases, the voltage level of the transfer output within the intended image region was at a predetermined level, assuring that the entirety of an image would be satisfactorily transferred. FIG. 5 also shows that the transfer output for the thick paper is greater than that for the ordinary paper. Further, if the volumetric resistivity of a thick sheet of paper is relatively low, the application of the transfer output may be started within the leading white margin of the paper, closer to the leading edge.

Also referring to FIG. 5, within the region correspondent to the intended image area of the recording medium, transfer voltage with a predetermined level is applied to transfer the image, assuming that the impedances of the transfer sheet and the entirety (inclusive of toner image) of the recording medium are substantially constant. During this period, either the constant voltage control which keeps the transfer voltage constant at a predetermined level, or the constant current control which keeps the transfer current (current which flows through transfer brush) constant, may be carried out. However, if the aforementioned impedances are unignorable, the constant current control is preferable.

In this embodiment, the characteristic of paper is described only in terms of thickness. However, it is also effective to carry out such control that switches the point at which the value of the transfer current is changed, depending on any of the paper properties other than thickness, for example, rigidity, surface resistance, volumetric resistivity, dielectric constant, and the like. For instance, even if a sheet of recording paper is thin, as long as the paper is high in rigidity and resiliency, it can be sufficiently curled. Therefore, in the case of this sheet of recording paper, the application of the transfer voltage may be started at a point close to the leading edge of the sheet, making it possible to reduce the width of the margin at the leading end of the sheet.

In the case of paper high in the value of volumetric resistivity, surface resistivity, or the like, even if the application of the transfer voltage is started relatively close to the leading edge of a recording medium, the recording medium will not be wrapped around a photosensitive drum. However, in the case of a sheet of recording paper low in resistivity, unless the application of the transfer voltage is started substantially away from the leading edge of the recording sheet, the leading edge of the recording sheet is negatively affected by the transfer current, creating problems; for example, the recording sheet wraps itself around the photosensitive drum. However, generally, paper with low resistivity is greater in dielectric constant compared to paper with higher resistivity. Therefore, the voltage level V, by which the transfer voltage must be started up to cause the transfer current to flow through the paper by the same amount as the current which flows through paper with high resistivity, is relatively small. Thus, when a recording sheet with low resistivity is in use, even if the application of the transfer voltage is started only a short distance past the leading edge of the recording sheet, it is assured that the toner image is transferred in its entirety. In other words, the leading white margin for a sheet of recording paper with low resistivity does not need to be as wide as that for a sheet of recording paper with high resistivity.

As described above, by switching, depending upon physical properties of a sheet of recording paper, the point at which the application of the transfer voltage is started before or past the leading edge of a sheet of recording paper, it is assured that the sheet of recording paper is properly adhered and conveyed to satisfactorily transfer the toner image in its entirety. In other words, an image forming apparatus may be configured so that it can be adjusted, by a user or automatically, to the thickness, various resistivities, rigidity, or the like, of recording medium, which is obvious.

Embodiment 2

Next, the second embodiment of the present invention will be described with reference to FIG. 6. In the first embodiment, the point at which the application of the transfer voltage is started before or past the leading edge of a sheet of recording paper, and also the state of the application, are switched depending upon the type of the sheet. However, it is also effective to switch the point at which the application of the transfer voltage is started before or past the leading edge of a sheet of recording paper, and also the state of the application, depending upon the amount of the moisture in a sheet of recording paper. Such an example is described below as the second embodiment of the present invention.

In an environment with low humidity, the value of the dielectric constant of paper becomes extremely small compared to that in an environment with high humidity, and so does the electrostatic capacity of the toner on a photosensitive drum. Therefore, much larger transfer current is necessary. Further, since paper loses moisture in an environment with low humidity, it becomes low in dielectric constant, and therefore, high in tap capacity, making it necessary for the value of the aforementioned final transfer voltage $V_1$ to be extremely large. Thus, if the transfer voltage is started up past the leading edge of a sheet of recording medium, it cannot be guaranteed that a toner image will be satisfactorily transferred onto the sheet, even to the portion close to the leading edge.

On the other hand, in an environment such as the aforementioned low humidity environment, a sheet of recording paper gains in resiliency, more effectively clinging to a transfer drum after it is curled by a curling mechanism. Therefore, it is assured that even if the application of the transfer voltage is started at the leading edge of the sheet, the sheet is satisfactorily adhered to the transfer drum.

On the contrary, in an environment with high humidity, a sheet of recording paper loses in resiliency, less effectively clinging to a transfer drum after its curling by a curling mechanism. In addition, the sheet absorbs moisture, losing in resistance value. Therefore, unless the application of the transfer voltage is started a substantial distance past the leading edge of the sheet, a portion of the transfer current flows into the leading edge of the sheet. As a result, the leading end portion of the sheet is adhered to a photosensitive drum, or in an extreme case, the sheet is wrapped around the photosensitive drum; in other words, it cannot be assured that the sheet is satisfactorily adhered to the transfer drum, or is satisfactorily conveyed.

Further, in a high humidity environment, the electrostatic capacity of the toner becomes smaller compared to that in a low humidity environment, requiring less transfer current. In addition, a sheet of paper absorbs moisture, gaining in dielectric constant, and therefore, losing in tap capacity. Therefore, the value of $+V_1$ does not need to be increased as much as in a low humidity environment, provided that the current required for the satisfactory image transfer is the same in both environments. Therefore, the transfer voltage can be started up from $V_0+V_q$ to $V_1$ in a relatively short period of time, making it less likely that the leading end of a toner image fails to be satisfactorily transferred.

Thus, in this embodiment, the point at which the application of the transfer voltage is started in a low humidity environment is made to be closer to the leading edge of a sheet of recording paper than the point for a high humidity environment, to assure the adherence of the leading edge and adjacency thereof to a transfer drum, and the resultant image quality.

In the case of an image forming apparatus enabled to form an image on both sides of a sheet of recording medium, when a sheet of recording medium is passed through a thermal fixing device for the second time to form an image on the second surface of the sheet in terms of the order in which an image is recorded, the tap capacity of the sheet is larger than when an image is formed on the first surface of the sheet, because the sheet is dried while it is passed through the thermal fixing device for the image formation on the first surface. Therefore, the value of the transfer voltage $V_1$ to be applied for the image formation on the second surface must be higher than that for the image formation on the first surface. On the other hand, during the image formation on the second surface, the sheet is more resilient than during the image formation on the first surface, and therefore, the sheet clings to the transfer drum more effectively after it is curled by the curling mechanism, than during the image formation on the first surface. Therefore, even if the application of the transfer voltage is started at the leading edge of the sheet, the sheet conveyance does not fail.

In other words, this embodiment is characterized in that when an image is formed on both sides of a sheet of recording medium, the point at which the application of the transfer voltage is started during the image formation on the second side of the sheet is made closer to the leading edge of the sheet than the point for the image formation on the first side of the sheet. With this arrangement, it is possible to assure both the adhesion of the leading edge to a transfer drum, and image quality.

Embodiment 3

Next, the third embodiment of the present invention will be described. In the preceding first and second embodiments, control was executed so that transfer current was prevented from flowing through the edge portion of a sheet of recording medium, and also that after the starting of the application of the transfer voltage, the transfer voltage reached a predetermined level in a period of time, equivalent to the width of the white margin at the leading end, after it began to be applied. This embodiment, however, is compatible with any system as long as the system is such that the transfer voltage is increased to a necessary level within a period equivalent to the width of the white margin at the leading end of the sheet after the transfer voltage begins to be applied.

In a system such as a conventional system in which the photosensitive drum and the transfer drum are equal in peripheral surface curvature, if a piece of recording medium fails to be sufficiently curled by a curling mechanism, allowing transfer current to flow through the leading edge of the recording medium results in the failure in recording medium conveyance, which was described previously. However, when a transfer belt is employed, or the curvature of a transfer drum is smaller than that of a photosensitive drum, even if the leading edge of a sheet of recording paper has burrs, quite often, all that is necessary is to execute control so that the current which flows through the leading edge of the sheet becomes smaller than the current which is flowed for image transfer during image formation. For example, if the amount of the transfer current to be flowed during image formation is set at a predetermined level of 20 $\mu$A, the amount of the current allowed to flow through the leading edge portion of the sheet is set low at approximately 10 $\mu$A, and the amount of the current is changed from approximately 10 $\mu$A to approximately 20 $\mu$A within a period equivalent to the width of the white margin at the leading end of the sheet. The current value at the leading edge of the sheet may be negative (for example, −1.5 $\mu$A). In other words, the amount of the current may be changed from −1.5 $\mu$A to approximately +20 $\mu$A.

Even in the case of a system such as the one described above, both the proper adhesion of the leading edge of a sheet of recording medium to a transfer drum, which is responsible for the reliable conveyance of the sheet, and image quality, are assured by switching the period in which the transfer current is changed, depending on the properties of the sheet.

The above described first to third embodiments may be employed in combination as they fit. For example, the timing with which the transfer output is changed depending on humidity and the properties (thickness, basis weight, and the like) of a sheet of recording medium may be controlled.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member for bearing an image;

a movable recording material carrying member for electrostatically carrying a recording material;

transfer means for electrostatically transferring the image from said image bearing member onto the recording material carried on said recording material carrying member at a transfer position;

wherein said apparatus is operable in a first mode in which an electric current through said transfer means starts to be changed before a leading edge of the recording material reaches the transfer position, so that the electric current through said transfer means becomes sufficient to transfer the image from said image bearing member to the recording material carried on said recording material carrying member, and in a second mode in which the electric current through said transfer means starts to be changed during passage of non-image forming area at a leading edge portion of the recording material through the transfer position, so that the electric current through said transfer means becomes sufficient to transfer the image from said image bearing member to the recording material carried on said recording material carrying member; and selecting means for selecting said first or second mode in accordance with a kind of the recording material.

2. An apparatus according to claim 1, wherein during image transfer, said transfer means is contacted to a side of said recording material carrying member opposite from the side carrying the recording material.

3. An apparatus according to claim 1, wherein an image of different colors is formed on the recording material by repeating electrostatic transfer of the image onto the same recording material.

4. An apparatus according to claim 1, wherein the current through said transfer means is changed from a first current to a second current.

5. An apparatus according to claim 4, wherein an absolute value of said first current is smaller than an absolute value of said second current.

6. An apparatus according to claim 5, wherein said first current is zero.

7. An apparatus according to claim 4, wherein said first current has a polarity which is different from that of said second current.

8. An apparatus according to claim 1, wherein in said second mode, timing of start of change of the current through said transfer means is controlled in accordance with a humidity.

9. An apparatus according to any one of claims 1 and 4–8, further comprising curling means for curling the recording material before the recording material is carried on said recording material carrying member.

10. An apparatus according to claim 9, wherein said curling means includes a plurality of rollers which are press-contacted to each other.

11. An apparatus according to any one of claims 1 and 4–8, wherein the kind of the recording material is a thickness of the recording material.

12. An apparatus according to any one of claims 1 and 4–8, wherein the kind of the recording material is a basis weight of the recording material.

13. An apparatus according to any one of claim 1, wherein the kind of the recording material is a rigidity of the recording material.

14. An image forming apparatus comprising:

an image bearing member for bearing an image;

a recording material carrying member for electrostatically carrying a recording material;

transfer means for electrostatically transferring an image from said image bearing member onto the recording material carried on said recording material carrying member; and control means for controlling a start timing of a change of a transfer output of said transfer means to an image transfer output, so as to correspond to a position in accordance with a kind of the recording material within a range including upstream and downstream portions of a leading edge of the recording material being fed, when an image forming area of the recording material passes through the transfer position.

15. An apparatus according to claim 14, wherein said control means changes the electric current from a first level to a second level which is the level for the image transfer operation when the image formation area of the recording material reaches the transfer position.

16. An apparatus according to claim 15, wherein an absolute value of the first level is smaller than an absolute value of the second level.

17. An apparatus according to claim 16, wherein the first level is substantially zero.

18. An apparatus according to claim 14, further comprising curling means for curling the recording material before the recording material is carried on said recording material carrying member.

19. An apparatus according to claim 18, wherein said curling means includes a plurality of rollers which are press-contacted to each other.

20. An apparatus according to claim 14, wherein the kind of the recording material is based on a thickness of the recording material.

21. An apparatus according to claim 14, wherein the kind of the recording material is based on a basis weight of the recording material.

22. An apparatus according to claim 14, wherein the kind of the recording material is based on a rigidity of the recording material.

* * * * *

UNITED STATES PATENT AND TRADEMARK OFFICE

CERTIFICATE OF CORRECTION

PATENT NO. : 6,564,020 B2
DATED : May 13, 2003
INVENTOR(S) : Ikuo Kuribayashi et al.

Figure 6:
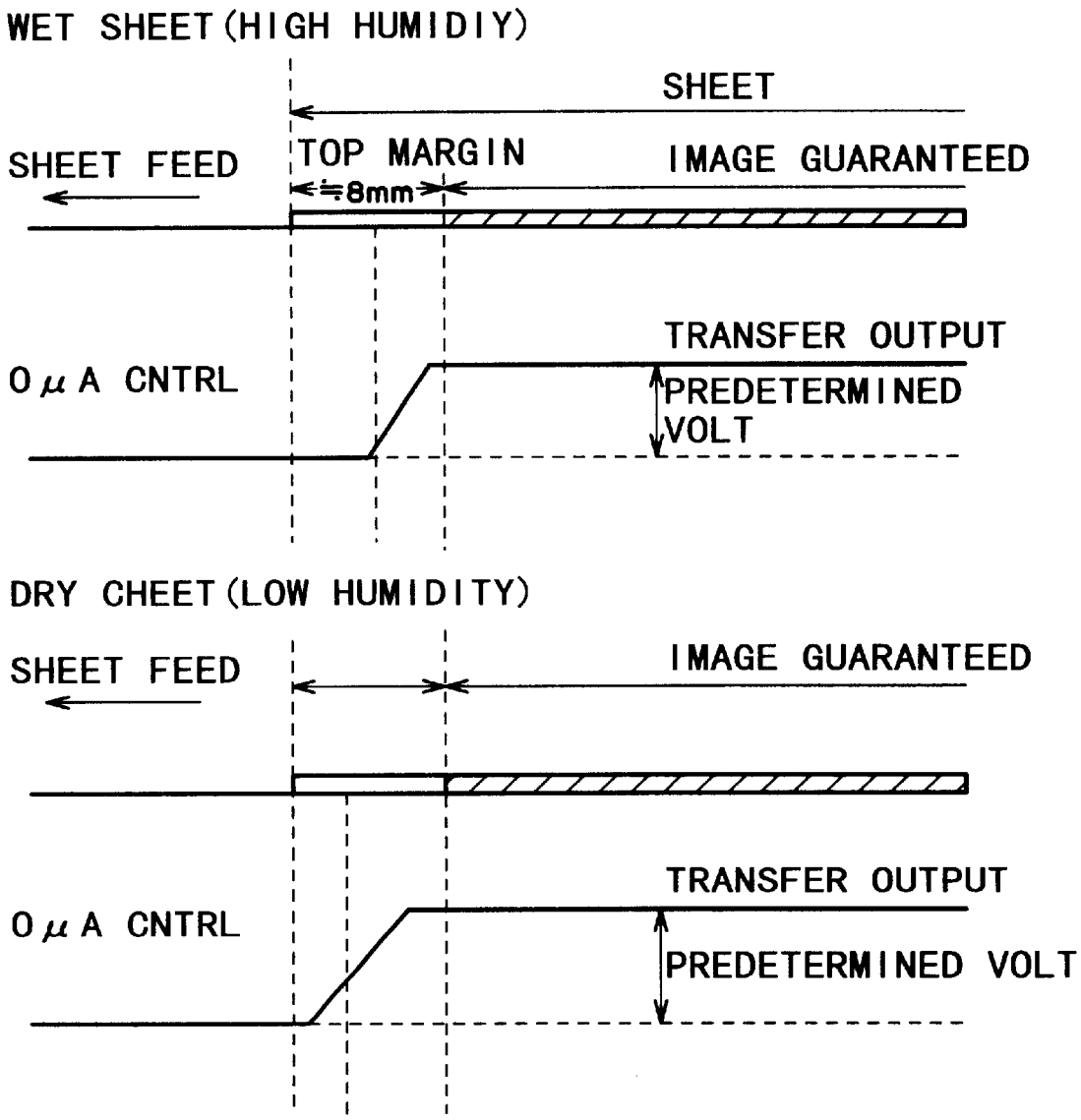
FIG. 6 is a schematic drawing which shows the transfer voltage levels for high and low humidity environments in the second embodiment.

It is certified that error appears in the above-identified patent and that said Letters Patent is hereby corrected as shown below:

Drawings,
Sheet 6, Figure 6, “CHEET” should read -- SHEET --.

Column 1,
Line 39, “charger” should read -- charge --.

Column 12,
Line 43, “any one of claim” should read -- claim --.

Signed and Sealed this

Twentieth Day of January, 2004

JON W. DUDAS
*Acting Director of the United States Patent and Trademark Office*